US010907593B2

(12) United States Patent
Higashi et al.

(10) Patent No.: US 10,907,593 B2
(45) Date of Patent: Feb. 2, 2021

(54) FUEL SUPPLY DEVICE

(71) Applicant: AISAN KOGYO KABUSHIKI KAISHA, Obu (JP)

(72) Inventors: Shinya Higashi, Kasugai (JP); Koji Yoshida, Commerce Township, MI (US); Kensuke Niwa, Nagoya (JP); Hiroyasu Kariya, Kariya (JP); Morihiro Takemura, Nisshin (JP); Tatsuki Fukui, Novi, MI (US); Akira Iida, Tokai (JP); Takuhito Fujiwara, Obu (JP); Takeaki Morizono, Tsushima (JP); Takehiro Yamauchi, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 83 days.

(21) Appl. No.: 15/999,840

(22) PCT Filed: Jan. 23, 2017

(86) PCT No.: PCT/JP2017/002076
§ 371 (c)(1),
(2) Date: Aug. 20, 2018

(87) PCT Pub. No.: WO2017/141628
PCT Pub. Date: Aug. 24, 2017

(65) Prior Publication Data

US 2019/0331073 A1 Oct. 31, 2019

(30) Foreign Application Priority Data

Feb. 19, 2016 (JP) ..... 2016-029969

(51) Int. Cl.
*F02M 37/20* (2006.01)
*F02M 37/00* (2006.01)
(Continued)

(52) U.S. Cl.
CPC ..... *F02M 37/04* (2013.01); *F02M 37/0017* (2013.01); *F02M 37/103* (2013.01);
(Continued)

(58) Field of Classification Search
CPC ... F02M 37/20; F02M 37/0017; F02M 37/103
(Continued)

(56) References Cited

U.S. PATENT DOCUMENTS 4,829,968 A * 5/1989 Onufer ..... B60K 15/03504 123/518
5,584,988 A * 12/1996 Hashimoto ..... B01D 29/15 210/136
(Continued)

FOREIGN PATENT DOCUMENTS

DE 69625487 T2 10/2003
JP H07180632 A 7/1995
(Continued)

OTHER PUBLICATIONS

Korean Office Action dated Aug. 28, 2019, for Korean Application No. 10-2018-7022955 (9 p.).
(Continued)

*Primary Examiner* — David Hamaoui
*Assistant Examiner* — John D Bailey
(74) *Attorney, Agent, or Firm* — Conley Rose, P.C.

(57) ABSTRACT

When a fuel tank is inclined at a negative slope and tilted to the right side, it may be tilted such that a position of a mesh member is relatively higher than a position of a vapor outlet of a vapor outlet passage. In this case, air may enter into a leak passage from an outlet port such that interfacial tension is generated in the mesh member. The interface between fuel and air is present at the mesh member, and the interfacial tension generated at the interface serves to prevent air from entering into a discharge pipe.

20 Claims, 7 Drawing Sheets

(51) Int. Cl.

| | |
|---|---|
| ***F02M 37/10*** | (2006.01) |
| ***F02M 37/04*** | (2006.01) |
| ***F02M 37/44*** | (2019.01) |
| ***F02M 37/50*** | (2019.01) |

(52) U.S. Cl.
CPC ..... *F02M 37/20* (2013.01); *F02M 37/44* (2019.01); *F02M 37/50* (2019.01)

(58) Field of Classification Search
USPC ..... 123/518
See application file for complete search history.

(56) References Cited

U.S. PATENT DOCUMENTS

| | | | | |
|---|---|---|---|---|
| 5,728,292 | A | 3/1998 | Hashimoto et al. | |
| 5,937,827 | A | 8/1999 | Eriksson et al. | |
| 6,058,911 | A * | 5/2000 | Hashimoto | B60K 15/077 123/514 |
| 6,718,953 | B1 * | 4/2004 | Torgerud | F02M 37/103 123/516 |
| 7,497,669 | B2 * | 3/2009 | Ito | F02M 37/048 415/55.1 |
| 9,926,899 | B2 | 3/2018 | Kato et al. | |
| 2003/0000503 | A1 * | 1/2003 | Takahashi | F02M 37/103 123/514 |
| 2004/0060547 | A1 * | 4/2004 | Aubree | F02M 37/103 123/497 |
| 2004/0182368 | A1 * | 9/2004 | Hashimoto | F02M 51/04 123/516 |
| 2005/0274361 | A1 * | 12/2005 | Ikeya | F02M 69/54 123/457 |
| 2006/0291995 | A1 * | 12/2006 | Ikeya | F04D 13/06 415/55.1 |
| 2009/0151699 | A1 * | 6/2009 | Honda | F02M 37/106 123/457 |
| 2011/0139278 | A1 * | 6/2011 | Kawajiri | B01D 35/0273 137/565.01 |
| 2013/0061960 | A1 * | 3/2013 | Jeon | F02M 37/103 137/544 |
| 2014/0096849 | A1 * | 4/2014 | Akagi | B01D 29/11 137/545 |

FOREIGN PATENT DOCUMENTS

| | | | |
|---|---|---|---|
| JP | H10339234 | A | 12/1998 |
| JP | 2003155991 | A | 5/2003 |
| JP | 2011122563 | A | 6/2011 |
| JP | 2013096370 | A | 5/2013 |
| JP | 2013117199 | A | 6/2013 |
| JP | 2016003616 | A | 1/2016 |

OTHER PUBLICATIONS

Japanese Office Action dated Jul. 19, 2019, for Japanese Application No. 2017-568001 (5 p.).
PCT/JP2017/002076 International Search Report and Written Opinion dated Mar. 28, 2017 (9 p.).
Indonesia Patent Application No. PID201806239 Office Action dated Nov. 11, 2019 (4 pages).
Thailand Patent Application No. 1801004896 PCT Office Action dated Mar. 27, 2020 (2 pages).
Indian Patent Application No. 201817030735 Examination Report dated Oct. 21, 2020 (5 pages).

* cited by examiner

FUEL SUPPLY DEVICE

CROSS-REFERENCE TO RELATED APPLICATIONS

The present application is a U.S. National Phase entry of, and claims priority to, PCT Application No. PCT/JP2017/002076, filed Jan. 23, 2017, which claims priority to Japanese Patent Application No. 2016-029969, filed Feb. 19, 2016, both of which are hereby incorporated herein by reference in their entireties for all purposes.

STATEMENT REGARDING FEDERALLY SPONSORED RESEARCH OR DEVELOPMENT

Not applicable.

BACKGROUND

The present disclosure relates to a fuel supply device that is installed into a fuel tank and serves to supply fuel from within the fuel tank to an internal combustion engine.

Conventionally, a fuel tank for storing fuel such as gasoline is mounted on an automobile (vehicle). A fuel supply device configured to supply fuel from the tank to an engine (internal combustion engine) as disclosed in Japanese Laid-Open Patent Publication No. 2009-144542 is installed inside the fuel tank. The fuel supply device generally includes a cover-side unit, a pump-side unit and a coupling mechanism. The cover-side unit is attached to an upper opening of the fuel tank. The pump-side unit is arranged within the fuel tank. The pump-side unit is provided with a fuel pump for pumping up fuel. The coupling mechanism connects the cover-side unit and the pump-side unit such that the pump-side unit is movable relative to the cover-side unit. The fuel supply device configured as described above is provided with a fuel supply passage to feed fuel pumped up by the fuel pump to an external engine. Incidentally, as the engine stops, this fuel pump stops a pump-up operation by which the fuel pump feeds fuel to an engine.

An automobile may be parked on a slope that is inclined in its lateral direction. In this case, the parked automobile will be tilted with respect to the ground in accordance with the tilt of the slope. Consequently, the above-described fuel tank as well as the fuel supply device, present inside of the car, will also be tilted. In this instance, if the amount of the fuel within the fuel tank is small, with the fuel tank being tilted, the above-described fuel supply passage would be exposed to the air. In such a case, when the pump-up operation of the fuel pump stops due to the stop of the engine, part of the fuel filled in the fuel supply passage may flow out so that air enters the fuel supply passage. This phenomenon is hereinafter referred to as "liquid drop".

If the engine is restarted in the above-described "liquid drop" state, due to the fuel supply passage being exposed to air in the tank, the fuel mixed with air will be fed to an engine. In this condition, with not enough liquid fuel supplied the ignitability of the engine suffers, and the starting ability of an engine will be significantly diminished. In view of this incapacity in performance, in order to reduce such a "liquid drop", it has been known to provide check valves at locations where the fuel flows out or the air flows in. However, in this approach, the number of components for the fuel supply device increases, and the overall manufacturing cost of the fuel supply device will be more expensive with reduced durability when the check valves are provided at each location.

The present disclosure is made in view of such a circumstance, to solve the described problem by the present disclosure, where a fuel supply device is provided that is installed into a fuel tank and serves to supply fuel from within the fuel tank to an engine, wherein the fuel supply device is provided with a function for reducing "liquid drop" when the pump-up operation of the pump is stopped so as to ensure the excellent restartability of an engine while reducing the number of components to constitute the fuel supply device at low cost with increased durability.

BRIEF SUMMARY

In order to solve the aforementioned problem, the fuel supply device according to the present disclosure adopts the following means. More particularly, the fuel supply device according to the first embodiment of the present disclosure is a fuel supply device for feeding fuel from within a fuel tank to an internal combustion engine comprising: a pump for pumping up fuel from within a tank, a fuel supply passage configured to feed the fuel pumped up by the pump to the internal combustion engine, a leak passage configured to branch the fuel pumped up by the pump off from the fuel supply passage to return into the tank, and a vapor outlet passage configured to discharge vapor generated within the pump, wherein a mesh member is arranged in the leak passage, and wherein the mesh member is configured to be able to generate interfacial tension with respect to an interface produced between fuel and air.

According to the fuel supply device of the first embodiment of the present disclosure, since the mesh member capable of generating interfacial tension with respect to the interface produced between fuel and air is arranged in the leak passage, it is possible to prevent air from entering upstream from said member into the leak passage, because of the interfacial tension generated by the mesh member. As a result, the function for reducing the "liquid drop" effect caused when the pump-up operation of the pump is stopped due to contact of the fuel supply passage with air as explained above, is achieved, while at the same time the increase in number of components is avoided, to achieve the dual effect of ensuring the excellent starting ability of an engine while providing a durable fuel supply device at low cost.

In the fuel supply device according to the second embodiment of the present disclosure, which is based off of the fuel supply device according to the first embodiment, even when the tank is tilted such that a position of the mesh member is relatively higher than a position of a vapor outlet of the vapor outlet passage, the interfacial tension generated by the mesh member bears the weight of fuel present between the mesh member and the vapor outlet to prevent the fuel from flowing out of the vapor outlet.

According to the fuel supply device of the second embodiment, even when the tank is tilted such that the position of the mesh member is relatively higher than the position of the vapor outlet, it is possible to prevent the fuel from flowing out of the vapor outlet due to the interfacial tension generated by the mesh member. As a result, the starting ability of the engine to which the fuel is provided by the fuel supply device can be improved since the fuel supply passage is filled with fuel to prevent the "liquid drop" effect from being present even when the vehicle is parked on a slope at an angle.

In the fuel supply device according to the third embodiment of the present disclosure, which like the second embodiment is also based off of the fuel supply device according to the first embodiment, even when lateral acceleration is applied to the tank in a direction from the mesh member to the vapor outlet of the vapor outlet passage, e.g. as a vehicle on which the tank is mounted turns around a corner, the interfacial tension generated by the mesh member can bear a weigh of fuel present between the mesh member and the vapor outlet to prevent fuel from flowing out of the vapor outlet.

According to the fuel supply device of the third embodiment, even when the lateral acceleration is applied to the tank as the vehicle takes a turn, the interfacial tension generated by the mesh member can bear the weight of the fuel that attempts to flows out of the vapor outlet, making it possible, therefore, to prevent the fuel from flowing out of the vapor outlet. As a result, even when lateral acceleration is applied to the fuel within the tank as the vehicle turns, a starting ability of the engine can be improved since the fuel is filled in the fuel supply passage to prevent the "liquid drop" effect from occurring.

In the fuel supply device according to the fourth embodiment of the present disclosure, which is based off of the fuel supply device according to any one of the first to third embodiments, the leak passage includes a first passage portion with its upstream side connected to a branched part from the fuel supply passage and with its downstream side extending from a bottom portion to a top portion, a bent passage with its upstream side continuous with and extending from the downstream side of the first passage portion and with its downstream side bent downward such that an extending direction from the first passage portion is also bent down, and a second passage portion with its upstream side continuous with and extending from the downstream side of the bent passage and with its (the second passage portion) downstream side extending from a top portion to a bottom portion, connected to a fuel discharge port locating blow.

According to the fuel supply device of the fourth embodiment, since the leak passage includes a first passage portion extending from the bottom portion to the top portion, the fuel within the first passage portion is prevented from being discharged out of the fuel discharge port. Furthermore, the bent passage portion and the second passage portion allow the leak passage to be connected to the fuel discharge port located below the first passage portion. Accordingly, even when tilted, the fuel within the first passage portion is prevented from being discharged while the fuel can be discharged to the fuel discharge port located below the first passage portion.

In the fuel supply device according to the fifth embodiment of the present disclosure, which is based off of the fuel supply device according to the fourth embodiment, an extended configuration of the first passage portion of the leak passage is oriented such that a position of the bent passage portion is relatively higher than a position of the vapor outlet even when the tank is tilted such that the position of the vapor outlet of the vapor outlet passage is relatively higher than the position of the mesh member.

According to the fuel supply device of the fifth embodiment, the fuel within the first passage portion is prevented from being discharged out of the fuel discharge port so that air will not enter inside from the vapor outlet since the position of the bent passage portion is relatively higher than the position of the vapor outlet even when the tank is tilted such that the position of the vapor outlet is relatively higher than the position of the mesh member. As a result, a starting ability of an engine can be improved since the fuel is filled in the fuel supply passage to prevent the "liquid drop" effect even when a vehicle is parked on a slope at an angle.

In the fuel supply device according to the sixth embodiment of the present disclosure, which is based off of the fuel supply device according to the fourth embodiment, an extended configuration of the first passage portion of the leak passage is oriented such that the position of the bent passage portion is relatively higher height-wise than the position of the vapor outlet in intersecting a fuel liquid level, which is tilted due to a lateral acceleration, even when the lateral acceleration is applied to the tank in a direction from the vapor outlet of the vapor outlet passage toward the mesh member as the vehicle mounted with the tank takes a turn.

According to the fuel supply device of the sixth embodiment, the fuel within the first passage portion is prevented from being discharged out of the fuel discharge port since the position of the bent passage portion is relatively higher height-wise than the position of the vapor outlet intersecting the fuel liquid level, which is tilted due to the lateral acceleration, even when the lateral acceleration is applied to the tank when the vehicle is turned. As a result, the starting ability of the engine is improved since the fuel supplied to said engine is filled within the fuel supply passage without air gaps, preventing the "liquid drop" effect even when the lateral acceleration is applied to the fuel within the tank when the vehicle is takes a turn.

In the fuel supply device according to the seventh embodiment of the present disclosure, which is based off of the fuel supply device according to the fourth embodiment, an outlet of the second passage portion is disposed in the vicinity of the vapor outlet of the vapor outlet passage.

According to the fuel supply device of the seventh embodiment, the liquid drop effect can be prevented by defining the length of the bent passage portion of the leak passage to extend up to a position near the vapor outlet of the vapor outlet passage even when the arrangement positions of the first passage portion and the bent passage portion are oriented to be low. As a result, the pump unit can be mounted on a thin fuel tank by orienting the arrangement position of the first passage portion and the bent passage portion to be low.

In the fuel supply device according to the eighth embodiment of the present disclosure, which is based off of the fuel supply device according to any of the first to sixth embodiments, the fuel discharge port of the leak passage, which serves to return the fuel into the fuel tank, is oriented to discharge fuel to a filter for fuel pumped up by the pump, and the vapor outlet of the vapor outlet passage, which serves to return the vapor into the tank, is also oriented to outlet vapor to the filter for fuel pumped up by the pump.

According to the fuel filter device according to the eighth embodiment, since the fuel discharge port and the vapor outlet are oriented to outlet to the filter which through the fuel pumped up by the pump, clean fuel, which has been filtered once by the fuel filter, is returned again to the fuel filter, therefore, enhancing the filtering efficiency of the fuel filter and enhancing the quality of fuel provided to the engine.

DETAILED DESCRIPTION

Figure 1:
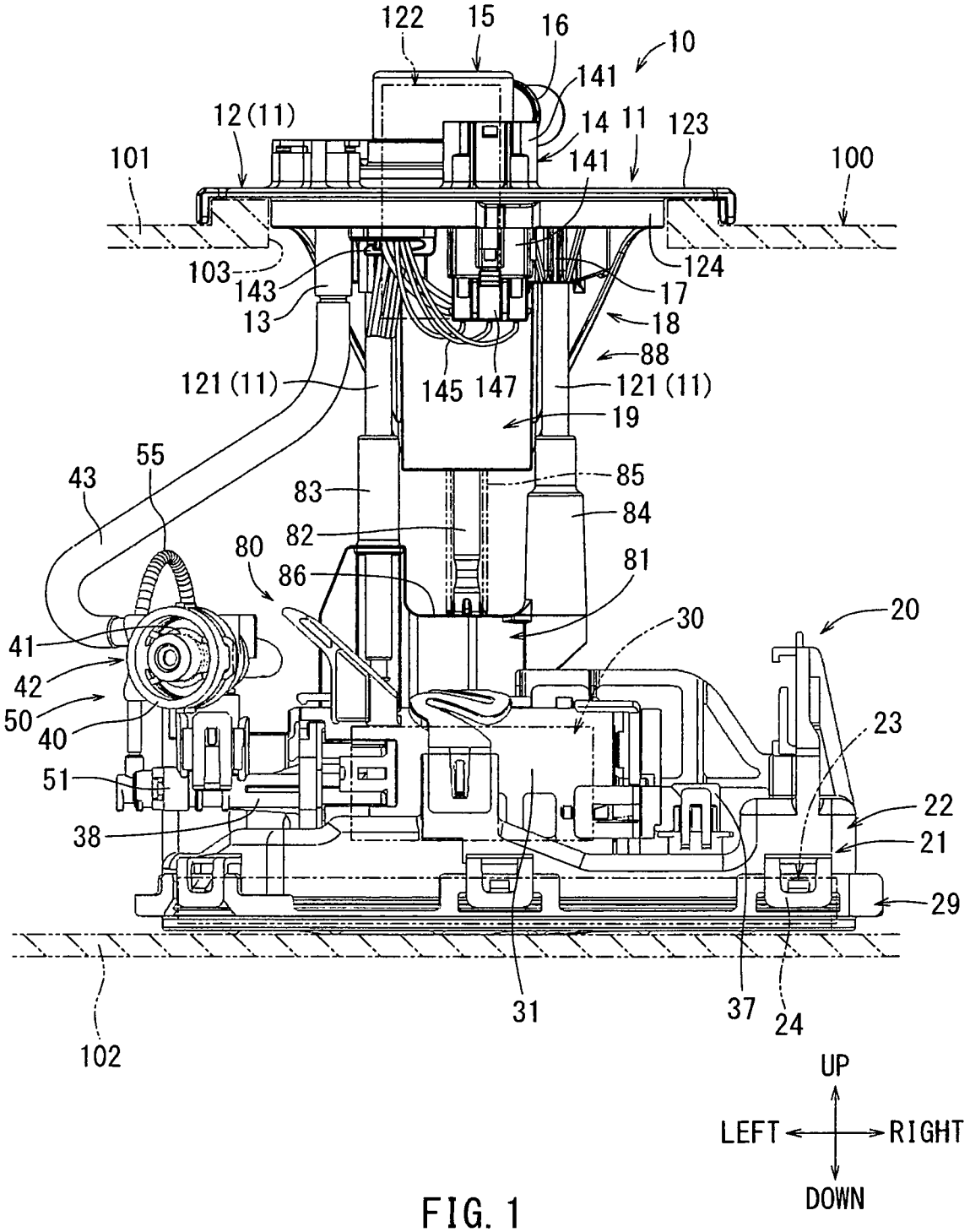
FIG. 1 is a front view showing a fuel supply device.
Figure 2:
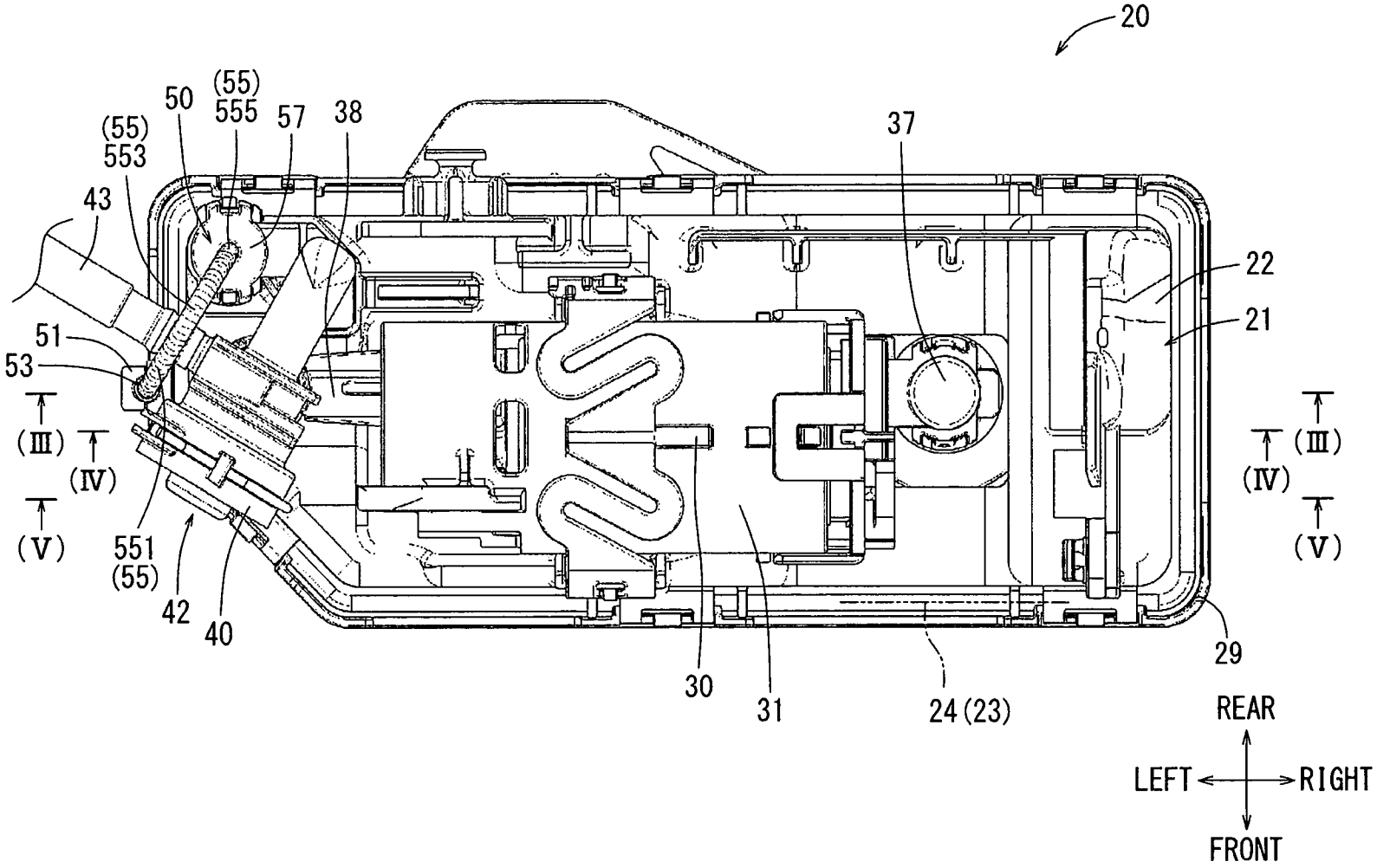
FIG. 2 is a top view showing a pump unit.
Figure 3:
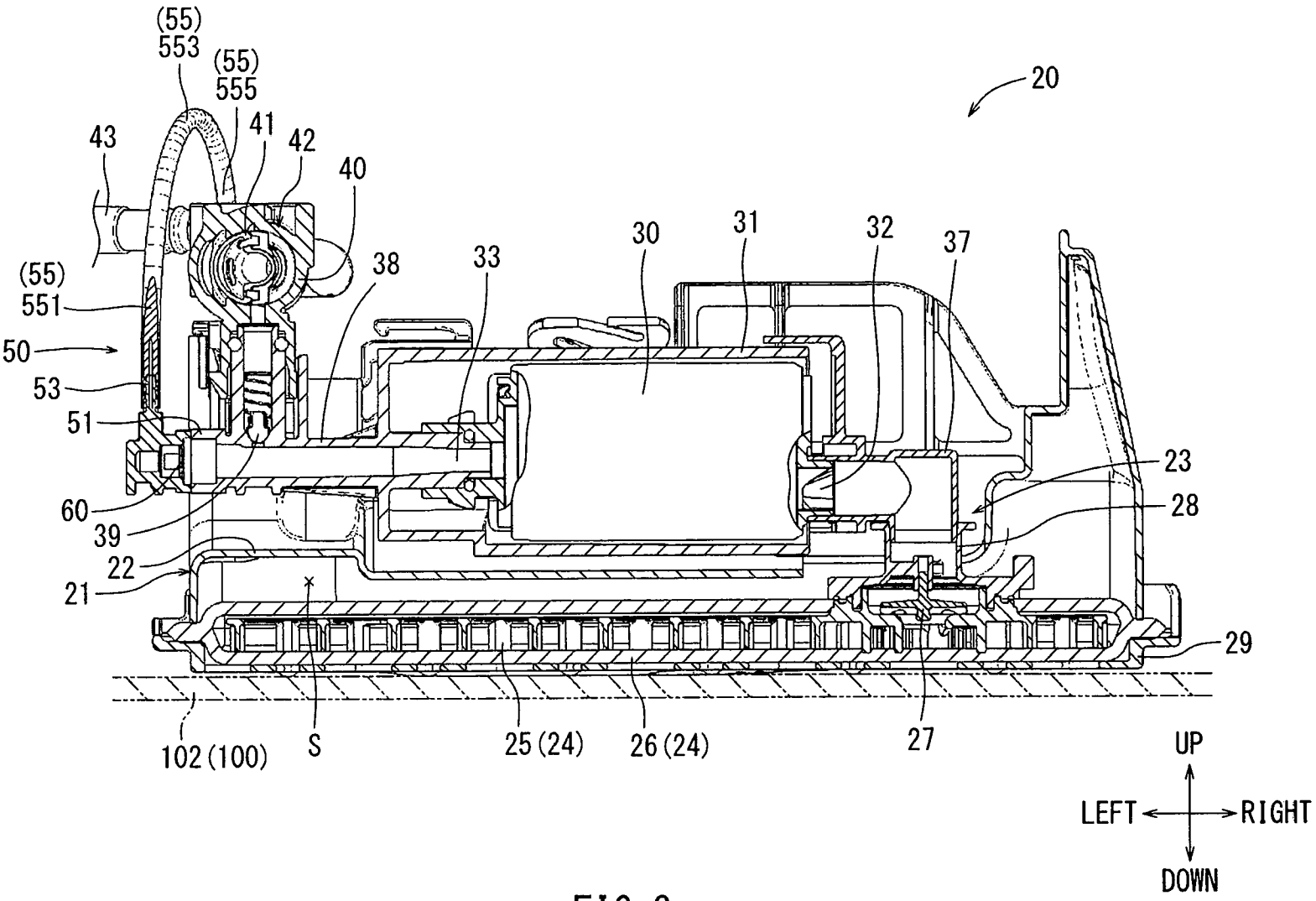
FIG. 3 is a cross-sectional view taken along (III)-(III) in FIG. 2.
Figure 4:
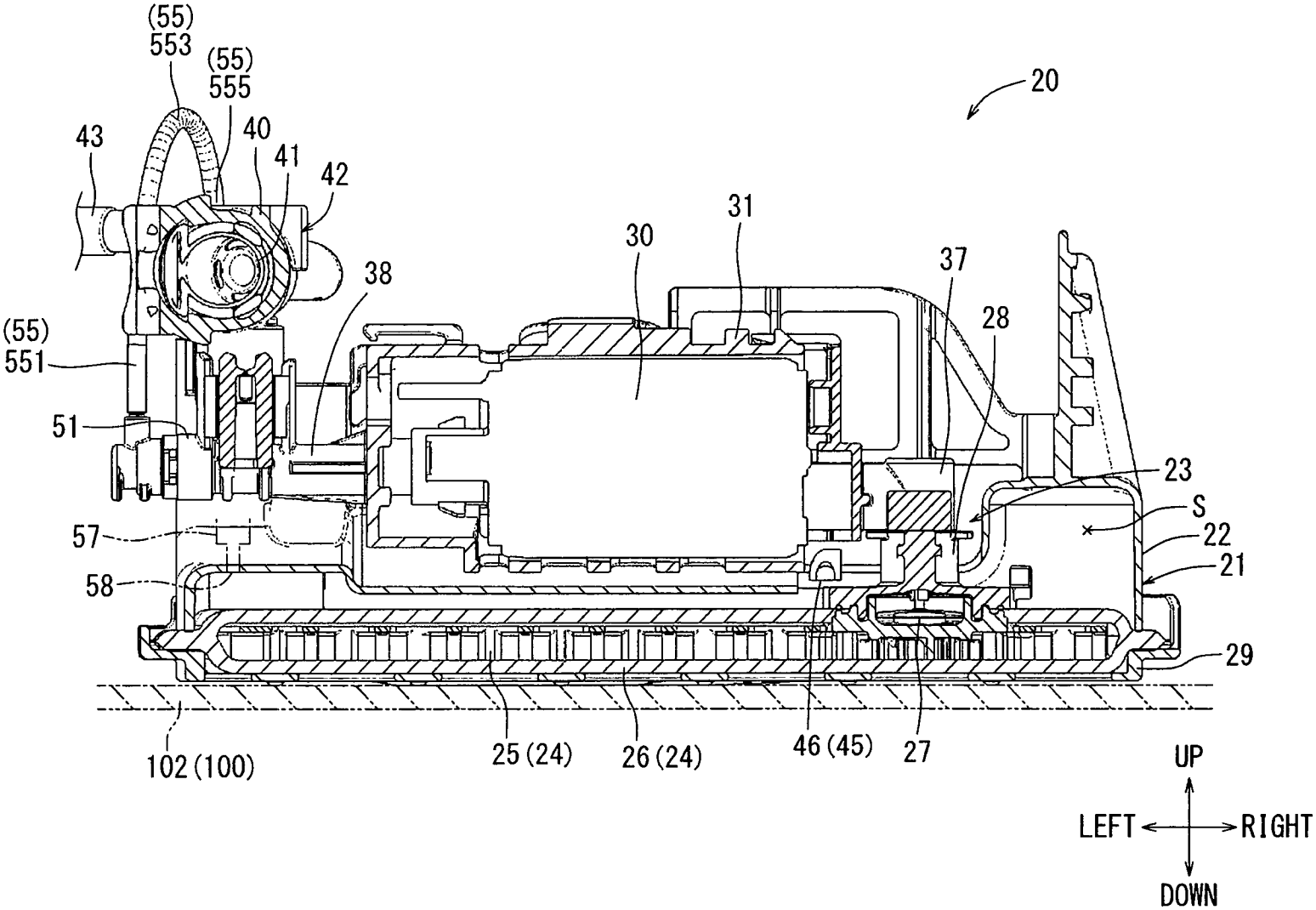
FIG. 4 is a cross-sectional view taken along (IV)-(IV) in FIG. 2.
Figure 5:
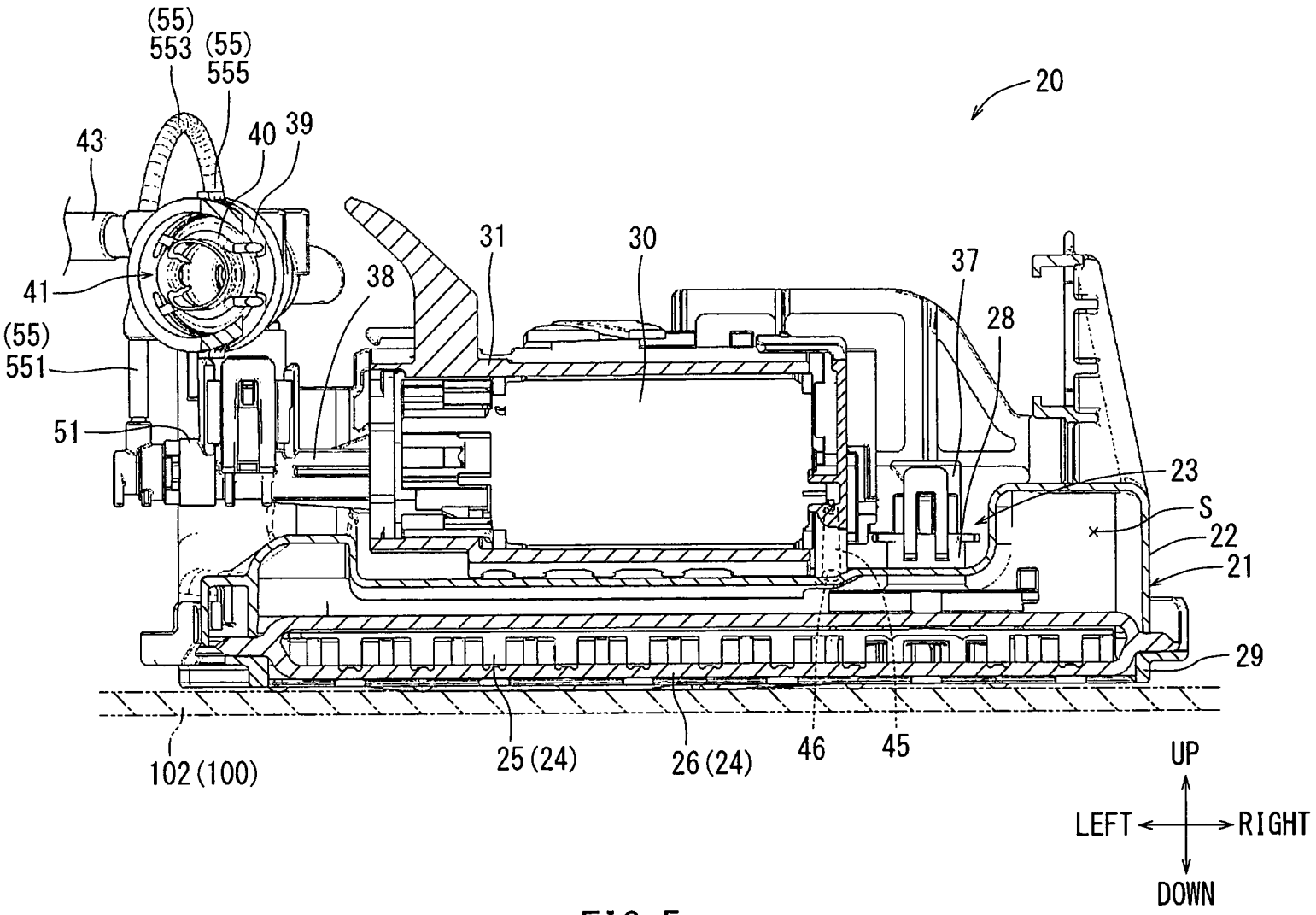
FIG. 5 is a cross-sectional view taken along (V)-(V) in FIG. 2.

Hereinafter, embodiments for carrying out the present disclosure will be described with reference to the drawings. Incidentally, FIG. 1 is a front view showing the fuel supply device 10. FIG. 2 is a top view showing the pump unit 20. FIG. 3 is a cross-sectional view taken along (III)-(III) in FIG. 2. FIG. 4 is a cross-sectional view taken along (IV)-(IV) in FIG. 2. FIG. 5 is a cross-sectional view taken along (V)-(V) in FIG. 2. Each of the frontward, rearward, upward, downward, leftward and rightward directions as shown in the drawings corresponds to each of the corresponding directions of a vehicle. Specifically, the frontward/rearward direction corresponds to the longitudinal vehicle length direction, the rightward/leftward direction corresponds to the vehicle width direction and the upward/downward direction corresponds to the vehicle height direction. The fuel supply device 10 is installed into the fuel tank 100 mounted on an automobile as a vehicle. The fuel supply device 10 serves to feed fuel from within the fuel tank 100 to an external engine, e.g. the engine of the vehicle upon which it is mounted (not shown).

An engine corresponds to an internal combustion engine (external to the fuel tank, but internal relative to the vehicle) according to the present disclosure. As shown, for example, in FIG. 1, the fuel tank 100 is made of resin and is formed as a hollow container shape having an upper wall 101 and a bottom wall 102. A circular hole opening 103 is formed on the upper wall 101. The fuel tank 100 is mounted onto the vehicle such that the upper wall 101 and the bottom wall 102 are oriented in a horizontal state (i.e. wherein the upper and lower wall extend in the left-to-right direction, remain parallel in the left-to-right direction) with respect to the vehicle (not shown). Gasoline as liquid fuel may be reserved in the fuel tank 100. The fuel tank 100 may deform (mainly expand or contract in the vertical direction) in response to the variation of internal pressure in the tank.

The fuel supply device 10 shown in FIG. 1 generally includes a flange unit 11, a pump unit 20 and a coupling mechanism 88, among other components. The flange unit 11 includes a flange main body 12, two left and right connecting shafts 121 and a fuel vapor valve 122. The flange unit 11 corresponds to a cover-side unit according to the present disclosure. The flange main body 12 is made of resin and is integrally formed by injection molding. The flange main body 12 is mainly formed as a cover plate 123 having a circular disk shape. A cylindrical fitting tubular portion 124, formed further as part of the cover plate 123 and flange main body 12, is concentrically formed, extending vertically downward along a circumferential perimeter radially inward and parallel to the circumferential periphery of the cover plate 123, and thus can fit within the hole 13 so as to plug it. To this end the fitting tubular portion 124 is formed to have a slightly smaller outer diameter than the outer diameter of the cover plate 123. The flange main body 12 corresponds to a cover member according to the present disclosure.

The cover plate 123 shown in FIG. 1 is attached to an upper wall 101 of the fuel tank 100 and fully surrounds and encloses the opening 103. The outer periphery of the cover plate 123 fits around the outer circumference of a circumferential peripheral edge surrounding the opening 103. The fitting tubular portion 124 is fitted into and plugs the opening 103 of the fuel tank 100. An outlet port 13 is formed on the cover plate 123. The outlet port 13 is in the form of a straight pipe protruding through both upper and lower surfaces of the cover plate 123. The outlet port 13 is disposed at the rear left portion of the fitting tubular portion 124, on the circumferential periphery of the fitting tubular portion 124. An electric connector 14 is formed on the cover plate 123.

The electric connector 14 shown in FIG. 1 includes rectangular prismatic upper and lower connector tubular portions 141 protruding respectively from both the upper and lower surfaces of the cover plate 123, as well as a plurality of metal terminals (not shown) which are embedded in the cover plate 123 by insert molding and arranged between the both connector tubular portions 141. The electric connector 14 is disposed at the frontward end region of the fitting tubular portion 124. A valve housing portion 15 in a cylindrical shape with a top is formed in the radial central region of the cover plate 123. An evaporation port 16 extending obliquely rearward to the right side above cover plate 123 is formed on the upper portion of the valve housing portion 15. Further, a pair of left and right shaft attachment portions 17 in a cylindrical shape with a top are formed on the lower surface of the cover plate 123 at the top of both of the left and right connecting shafts 121, spaced apart at a predetermined distance from each other. Both of the shaft attachment portions 17 are arranged at the rear portion of the fitting tubular portion 124, at the rear left area and the rear right area of said rear portion, respectively. A stand-off portion 18 is formed on the lower surface of the cover plate 123.

The connecting shafts 121 shown in FIG. 1 are hollow pipes, which may be made of metal, and the like. One end (upper end) of each connecting shaft 121 is connected to a respective shaft attachment portion 17 of the flange main body in a press fitting configuration. As a result, both left and right connecting shafts 121 are provided at the flange main body 12, such that they both extend downwardly from the flange main body 12 and are positioned parallel to each other. An outer contour of the fuel vapor valve 122 is formed in a cylindrical, columnar shape. The upper portion of the fuel vapor valve 122 is fitted and accommodated within the valve housing portion 15 of the flange main body 12. Regarding the evaporated fuel valve 122, as an example, an integrated valve including a fuel vapor control valve and a full tank regulating valve may be used as the fuel vapor valve 122. The fuel vapor control valve opens only when the internal pressure within the fuel tank 100 is smaller than the predetermined value, while the fuel vapor control valve closes when the internal pressure is increased to be greater than the predetermined value. Consequently, the full tank regulating valve opens unless the fuel within the fuel tank 100 is fully filled, while the full tank regulating valve closes when the tank is fully filled up.

A fuel supply pipe leading to the external engine is connected to the upper end of the outlet port 13 of the flange main body 12. Further, an external connecter is connected to the upper connector tubular portion 141 of the electric connector 14. Furthermore, a fuel vapor piping member, which may be made of a hose leading to a canister, is connected to the evaporation port 16 at the flange main body 12. The canister may include adsorbents (for example, activated carbon) capable of adsorbing and desorbing fuel vapor generated in the fuel tank 100. The fuel vapor generated within the fuel tank 100 may be discharged to the canister when the fuel vapor control valve for the fuel vapor valve 122 is opened.

Hereinafter, the pump unit 20 will be described with reference to FIG. 1 to FIG. 5. For example, as shown in FIG. 1, the pump unit 20 is placed flush against the bottom wall 102 within the fuel tank 100 in a horizontal state (laterally placed state) where its height in the upward/downward direction is at its minimum (zero incline). The pump unit 20 includes a sub-tank 21, a fuel pump 30 and a joint member 80 etc. The pump unit 20 corresponds to a pump-side unit according to the present disclosure and the fuel pump 30 corresponds to a pump according to the present disclosure. Further, the sub-tank 21 corresponds to a tank according to the present disclosure. As shown in FIG. 2, the sub-tank 21 includes a tank main body 22, a fuel filter 23 and a bottom surface cover 29. The tank main body 22 is made of resin and formed in an up-side down shallow box shape where the lower basal surface of said shape is opened. The tank main body 22 is formed in an elongated quadrangular shape wherein its longitudinal direction is in the left-to-right direction as seen from a plan view. An opening hole is formed on the upper wall portion of the tank main body 22 that serves to introduce fuel from within the fuel tank 100 into the sub-tank 21. A suction pipe 37 of the fuel filter 23, which will be described next, is connected to the fuel suction side of the fuel pump 30.

As shown in FIG. 3, the fuel filter 23 includes a filter member 24 and a suction pipe 37. The filter member 24 includes an inner skeleton member 25, a non-woven fabric 26 with its interior held in an expanded state by said skeleton member 25, a connecting pipe 28 and a valve 27. The inner skeleton member 25 is made of resin and is disposed in the hollow interior portion of a space surrounded by the non-woven fabric 26 held in an expanded state by the inner skeleton member 25. This inner skeleton member 25 constitutes a framework, which maintains the filter member 24 in the expanded state. The non-woven fabric 26 is formed as a hollow bag shape (fully enclosing a hollow interior) having an elongated quadrangular shape which is longitudinally elongated in the left-to-right direction as seen from the plan view, and is flat in the vertical direction. The fuel is filtered by passing through this non-woven fabric 26. The connecting pipe 28 is attached on the upper surface of the non-woven fabric 26 and flow through said pipe is controlled via the valve 27, which is present in the interior of the connecting pipe. As for the valve 27 and the connecting pipe 28, the valve 27 is present at the interface between the connecting pipe 28 and the non-woven fabric 26, where the valve 27 leads into the hollow interior portion of the non-woven fabric 26 which is supported by the inner skeleton member 25. This filter member 24 is configured to filter fuel from two sources from two separate flow paths, one source of which is drawn from within the fuel tank 100 into the fuel pump 30 through from the lower surface of the filter member 24 and through the hollow interior portion of the non-woven fabric 26, and the other source of which is drawn from within the sub-tank 21 into the fuel pump 30 through from the upper surface of the filter member 24, and through the hollow interior portion of the non-woven fabric 26.

The valve 27 and connecting pipe 28 are coupled to the inner skeleton member 25, for example, by snap-fit engagement. The connecting pipe 28 is disposed within and extends upwards through an opening hole formed on the upper surface of the tank main body 22. A suction pipe 37 is connected to the connecting pipe 28. The suction pipe 37 is formed on and extends from the right end of a pump casing 31, which will be described later. A fuel inlet port 32 provided on one end (right end) in an axial direction of the fuel pump 30 is connected to the suction pipe 37, wherein the suction pipe 37 fully encloses, extends from, and shares a contiguous boundary with the circumferential periphery of the fuel inlet port 32, where inlet fuel first flows through the suction pipe 37 and then through the suction pipe 37 is inlet into fuel inlet port 32. In this way, the fuel filtered by the filter member 24 is sucked through the fuel filter member 24, into connecting pipe 28, into the suction pipe 37 connected to connecting pipe 28, and then finally into the fuel inlet port 32 which inlets the fuel to fuel pump 30, in that order. Since the filter member 24 is formed to be longitudinally elongated in the lateral left-to-right direction, the filtering area may be increased, to ensure that the pump 30 is sucking liquid so that the suction of air, even during when vehicle traverses a curve, can be prevented.

As shown in FIGS. 3 to FIG. 5, the filter member 24 is arranged so as to span the entire longitudinal length of the tank main body 22, and as such it spans the entire lower opening of the tank main body 22, forming a semipermeable barrier. An upper surface of the filter member 24 faces upward toward the interior space of the tank main body 22. Consequently, the tank main body 22 and the filter member 24 collectively define a fuel reservoir space S between the two within the sub-tank 21. The fuel introduced from the opening hole in the upper wall of the tank main body 22 into the sub-tank i.e. into the fuel reservoir space S will be reserved in the fuel reservoir space S defined within the sub-tank 21. Further, the bottom surface cover 29 is made of resin and formed in a lattice plate configuration, which while rigidly fortifying and being fixed to surround the bottom basal surface of the tank main body 22, allows the fuel to flow through the lattice holes there-through. The bottom surface cover 29 is coupled to the bottom basal surface of the tank main body 22 by snap-fit engagement etc. around the extent of the outer periphery of the bottom surface. In particular, a peripheral edge around the outer peripheral surface of filter member 24 is clamped between the tank main body 22 and the bottom surface cover 29. Therefore, with this configuration even when the bottom surface cover 29 is in contact with the bottom wall 102 of the fuel tank 100, because fuel is allowed to flow through the lattice holes of bottom surface cover 29 and the semipermeable surface of the fuel filter member 24, it is possible to suck the fuel stored within the fuel tank 100 into the filter member 24 from through the lattice meshes of the bottom surface cover 29 and through the lower surface of the filter member 24.

The fuel pump 30 is an electric fuel pump configured to suck and discharge fuel. As explained above, the fuel pump 30 is able to pump up fuel from within the sub-tank 21. The outer contour of the fuel pump 30 is formed to have a substantially cylindrical columnar shape with the longitudinal axis lying in the left-to-right lateral direction. The fuel pump 30 is accommodated within the pump casing 31 made of resin. The pump casing 31 is coupled to the tank main body 22 of the sub-tank 21 by snap-fit engagement. As described above, the fuel pump 30 is placed on the sub-tank 21 in a horizontal state i.e. in a laterally placed manner where its longitudinal axial direction is oriented in the lateral direction, with a circular cross-section in the up-down front-rear cross-sectional directional plane. As shown in FIG. 1, the fuel pump 30 is electrically connected to a connection connector 147 via wiring members 145 constituting wires which are partially shown , and which extend into the hollow interior of the left and right connecting shafts 121. The electrical connection connector 147 is connected to a lower connector tubular portion 141 of an electric connector 14 on the flange main body 12. In this way, electric power from the power source is supplied to the fuel pump 30 via the wiring members 145. To prevent tangling of wires, the wiring members 145 are anchored by a hooked to a hook portion 143 at the flange main body 12.

As shown in FIG. 3, an outlet pipe 38 is formed to extend from within a recessed portion of the pump casing 31, through the left end of the pump casing 31. The outlet pipe 38 corresponds to a fuel supply passage according to the present disclosure. This outlet pipe 38 is a cylindrical-shaped piping that serves to feed the fuel pumped up by the fuel pump 30 to an engine. This outlet pipe 38 is connected to the fuel outlet 33 provided at the other end (left end) of the fuel inlet port 32 of the fuel pump 30 in the longitudinal axial left-to-right direction. A check valve 39 is disposed in the inside of the pump casing 31 outlet pipe 38, proximate to the left end of the pipe, in an adjacent manner above the pipe 38. The check valve 39 prevents the flow of the fuel in the reverse direction that is opposite from the fuel pump 30 to the discharge direction (from the outlet 33 towards the fuel inlet port 32). A case 40 for the pressure regulator is coupled to this outlet pipe 38 by a snap-fit engagement etc. The pressure regulator 42 is fitted into the case 40, as well as an anti-removal member 41, which is also fitted into the case 40 utilizing elastic deformation, to prevent the pressure regulator 42 from being removed. The pressure regulator 42 discharges excessive fuel to regulate the fuel pressure when the fuel pressure within the outlet pipe 38 exceeds a predetermined pressure. The piping member 43 is connected to the outlet pipe 38 via the pressure regulator 42. The piping member 43 is made of a flexible hose and connected to the outlet port 13 at the flange main body 12 of the flange unit 11, forming the outlet flowpath of liquid from the pressure regulator 42, to the outlet port 13.

Hereinafter, a joint member 80 shown in FIG. 1 will be described. The joint member 80 is a resin molded product which is integrally molded by injection molding. This joint member 80 corresponds to a joint portion according to the present disclosure. The joint member 80 is mainly formed of the connecting plate 81, which is flat in the front to rear direction and is an elongated strip plate extending in the vertical direction. A lower end of the connecting plate 81 is rotatably connected to the rear side of the tank main body 22 of the sub-tank 21 via a support shaft (not shown) extending in the front to rear direction. As a result, the sub-tank 21 of the pump unit 20 is rotatably connected to the joint member 80 in the vertical direction, where the sub-tank 21 and the joint member 80 are rotatable about the support shaft with respect to each other. A vertically upright guide column 82 is formed to extend upwards from the central region of the connecting plate 81 in the lateral left-to-right direction.

The guide column 82 shown in FIG. 1 is arranged to be concentric and share the same radial center with respect to a support tubular portion 19 of the stand-off portion 18 of the flange unit 11. The coupling mechanism 88 connects the pump unit 20 to the flange body 12 of the flange unit 11 so that the pump unit may be able to move relative to the flange unit 11 in the vertical direction. The coupling mechanism 88 is configured to have two connecting shafts 121 provided extending vertically downward from the flange main body 12 of the flange unit 11 and into the joint member 80 provided at the pump unit 20. A left connecting tubular portion 83 and the right connecting tubular portion 84, into which the respective left and right connecting shafts 121 extend, are formed at both the left and right portions of the joint member 80, in parallel with each other. A lower portion of the spring 85 is fitted onto and surrounding the guide column 82. The spring 85 is formed of a coil spring.

A lower portion of the spring 85 abuts a stopper portion face 86 of the joint member 80 extending in the left-to-right direction. An upper portion of the spring 85 is inserted into the support tubular portion 19 of the stand-off portion 18 of the flange main body 12, which as described is concentric with the column 82, which the spring 85 surrounds. The upper face of this spring 85 abuts a ceiling of the support tubular portion 19 (at the upper basal surface of the cylinder shape formed by the support tubular portion 19). In this way, the spring 85 is interposed between the flange main body 12 of the flange unit 11 and the joint member 80, biasing both members outward in the vertical direction (i.e., the up-to-down direction). In this manner, the spring 85 biases the flange main body 12 and the joint member 80 in a direction to enlarge the vertically spaced interval between them. Consequently, the pump unit 20 is elastically pressed downward such that the bottom surface cover is pressed flush against the bottom wall 102 of the fuel tank 100. The spring 85 has a slight circumferential gap between itself and the guide column 82.

As shown in FIG. 5, a vapor outlet passage 45 is provided at the right end of the fuel pump 30. The vapor outlet passage 45 is a passage to discharge the fuel vapor (air bubbles) generated in the interior of the fuel pump 30 out of the fuel pump 30. This vapor outlet passage 45 is integrally provided as part of the pump casing 31 that serves to accommodate the fuel pump 30. The vapor outlet passage 45 is formed in a tubular shape extending downward from the lower right end of the fuel pump 30. The lower end of the vapor outlet passage 45 opens downward formed as a vapor outlet 46.

The vapor outlet 46 communicates with the fuel reservoir space S in the sub-tank 21 such that the fuel vapor generated in the interior of the fuel pump 30 is discharged through vapor outlet 46 into the fuel reservoir space S within the sub-tank 21. Specifically, the vapor outlet 46 is oriented towards the fuel filter 23 in order to discharge the fuel vapor to the fuel reservoir space S. The fuel vapor generated in the interior of the fuel pump 30 is the vapor of the fuel that has filtered by the fuel filter 23. Therefore, the fuel vapor reserved in the fuel reservoir space S within the sub-tank 21 through the vapor outlet passage 45 is clean fuel that has already been filtered by the fuel filter 23. Since the clean fuel that is filtered is reserved again in the sub-tank 21, the filtering efficiency of the fuel filter 23 is improved since the already filtered fuel undergoes another filtering cycle.

Further, as shown in FIGS. 3 to 5, the outlet pipe 38 is provided with a branch pipe 51. The branch pipe 51 is arranged intersecting and extending from the outlet pipe 38, upstream of the check valve 39. This branch pipe 51 is formed as a part of a leak passage 50. The leak passage 50 is piping that serves to branch the fuel flow from the outlet pipe 38, wherein the fuel flow is pumped up to said outlet pipe by the fuel pump 30, and the branched flow returns again into the sub-tank 21. Since the leak passage 50 is connected to the outlet pipe 38 in this manner, the fuel pump 30 is allowed to pump more fuel than the amount of fuel to be supplied. By pumping fuel at a steady amount, it is possible to eliminate low speed pumping of the fuel pump 30, which in turn prevents heat generation of the pump motor. The branched pipe 51 extends forward along the longitudinal axial left-to-right direction of the fuel pump 30. A mesh member 60 is arranged inside of the branch pipe 51 which is a part of the leak passage 50.

The mesh member 60 shown in FIG. 3 may be a metal plate with a plurality of fine pores. The plurality of the fine pores of the mesh member 60 may be formed to be large enough such that the fuel fed from the fuel pump 30 can pass there-through. However, at the same time, the small size of the plurality of fine pores acts to enhance the interfacial tension (surface tension) of the interface between the air and the fuel utilizing the viscosity of the fuel (for example, gasoline). Specifically, the mesh member 60 is configured such that large interfacial tension can be generated per fine pore when the interface between the air and the fuel is generated by these pores. The magnitude of such interfacial tension generated may be appropriately tailored and determined by selecting the material of the mesh member 60, and/or by the number or size of the pores in the mesh member 60. Further, the size of these pores (inner diameter of each pore, length of each pore in the longitudinal axial left-to-right direction of flow) is determined considering both ease of fuel flow through said pores, as well as the magnitude of the generated interfacial tension. Specifically, these pores may generate necessary and sufficient liquid film pressure using the fuel (for example, gasoline), as the liquid flowing there-through.

As shown in FIG. 3, the leak passage 50 includes the branch pipe 51 as well as a hose connector 53, a curved hose 55 and a fuel discharge port 57 (see FIGS. 2 and 4). The hose connector 53 is provided at the downstream end of the branch pipe 51, at its left end. This hose connector 53 is formed to be connected with one end of the curved hose 55. Specifically, the hose connector 53 is formed in a tubular shape that extends upward, orthogonally intersecting the branch pipe 51 extending forward in the left-to-right axial longitudinal direction of the fuel pump 30. The curved hose portion 53 may comprise a hose made of a flexible material. One end of this curved hose 55 is connected to the hose connector 53, and extends upwards while the other end is connected to the fuel discharge port 57, and extends downwards into said port, making the curved hose 55 form approximately an upside-down U shape. As a result of this configuration, the curved hose 55 can feed the fuel downstream from the hose connector 53 from the branch pipe 51 connected to the outlet pipe 38 of the pump to the fuel discharge port 57, wherein both ends of the curved hose 55 are connected with the hose connector 53 and the fuel discharge port 57, respectively.

As shown in FIGS. 2 to 4, the upside-down U shape of the curved hose 55 is be distinguished into three passage portions 551, 553 and 555, in accordance with the flow direction of the fuel. In particular, the curved hose 55 is formed with the first passage portion 551, the bent passage portion 553 and the second passage portion 555, wherein the passages channel upstream-to-downstream flow of the fuel in the leak passage 50. A base side (the upstream end) of the first passage portion 551 comprises the end of the curved hose 55 and is connected to the hose connector 53. The first passage portion 551 is defined as a passage extending from said base side upwards in the down-to-up direction, from bottom to top, to the extent that the curved hose 55 extends approximately vertically upward before bending, as shown in FIG. 3.

The bent passage portion 553 is defined as a passage between the first passage portion 551 and the second passage portion 555. The bent passage portion 553, at its upstream side is continuous from the downstream side of the first passage portion 551 toward the upstream side of second passage portion 555, at the downstream side of bent passage portion 553. The bent passage portion 553 is bent in a shape such that the passage turns down in a U-turned manner from the upstream to the downstream, wherein the extent of passage 553 matches the top of the upside-down U shape of curved hose 55. Specifically, the bent passage portion 553 is bent to extend upward from the bottom extending from the first passage portion 551, and to return downward so that its end is oriented downward, but at an incline or decline at the entire extent of its length (i.e., bent passage portion 553 does not extend approximately vertically without bending in the up-down direction, as the first or second passage portions 551 and 555 do). The upstream end of the second passage portion 555 is continuous with the downstream end of the bent passage portion 553. This second passage portion 555 is defined as a passage extending from its top at its upstream side, or downstream side of bent passage portion 553, in an approximately vertical up-to-down direction not at a decline (not bent at any angle) to its bottom at its downstream side. A downstream tip end of the second passage portion 555 comprises the other end of the curved hose 55 and is connected to the fuel discharge port 57 below it. The fuel discharge port 57 is integrally provided with the sub-tank 21.

As shown in FIG. 2, the downstream tip end of the second passage portion 555, which is the downstream end of the curved hose 55, is connected to the fuel discharge port 57. The fuel discharge port 57 defines a part of the leak passage 50 and serves to return the fuel fed from the fuel pump 30 through the branch pipe 51 and back into the sub-tank 21. As shown in FIG. 4, the discharge port 58 of this fuel discharge port 57 opens downward, and is formed to have a downwardly tapered T-shape. This discharge port 58 is in fluid communication with the fuel reservoir space S within the sub-tank 21 such that the fuel fed from the fuel pump 30 is discharged into the fuel reservoir space S within the sub-tank 21. Specifically, the fuel discharge port 57, from its bottom end discharge port 58, discharges the fuel from the leak passage 50 toward the fuel filter 23. Incidentally, the fuel fed from the fuel pump 30 to the leak passage 50, is fuel that has already been filtered by the fuel filter 23. As a result, the fuel that is passed through the leak passage 50 and reserved in the fuel reservoir space S within the sub-tank 21 is clean fuel that has already been filtered by the fuel filter 23. The clean fuel filtered in this way is reserved again for filtration in the sub-tank 21 enhancing the filtration efficiency of the fuel filter 23 and improving the quality of fuel by multiple rounds of filtration.

As shown in FIG. 1, according to such a fuel supply device 10, when the fuel pump 30 is driven by supplying power from the outside, the fuel pump 30 sucks both fuel from within the fuel tank 100 and the fuel from within the sub-tank 21 through the fuel filter 23 and pressurizes fuel from both of said sources. The pressure regulator 42 regulates the fuel pressure to a particular threshold and the fuel is discharged to the piping member 43, from which the fuel may be supplied further onward to an engine from the outlet port 13 of the flange unit 11. The fuel tank 100 undergoes deformation, i.e. expands and contracts, due to the variation of the internal pressure of the tank due to the variation of temperature, the amount of fuel, etc. Accordingly, the height, i.e. the vertically spaced apart interval between the upper wall 101 and the bottom wall 102, varies (is increased and reduced). In this case, the flange unit 11 and the pump unit 20 move relative to each other in the vertical direction via the coupling mechanism 88 between the flange unit 11 and the joint member 80 of the pump unit 20 such that both units 11 and 20 correspond to the variation in the height of the fuel tank 100, and are able to adjust to any such deformation, so that the flange unit 11 and the pump unit 20 may conform their shape to the variation of height of the fuel tank 100, and still be able to function. Therefore, the sub-tank 21 of the pump unit 20 may be maintained in a state pressed flush against the bottom wall 102 of the fuel pump 100 due to the biasing force of the spring 85.

Figure 6:
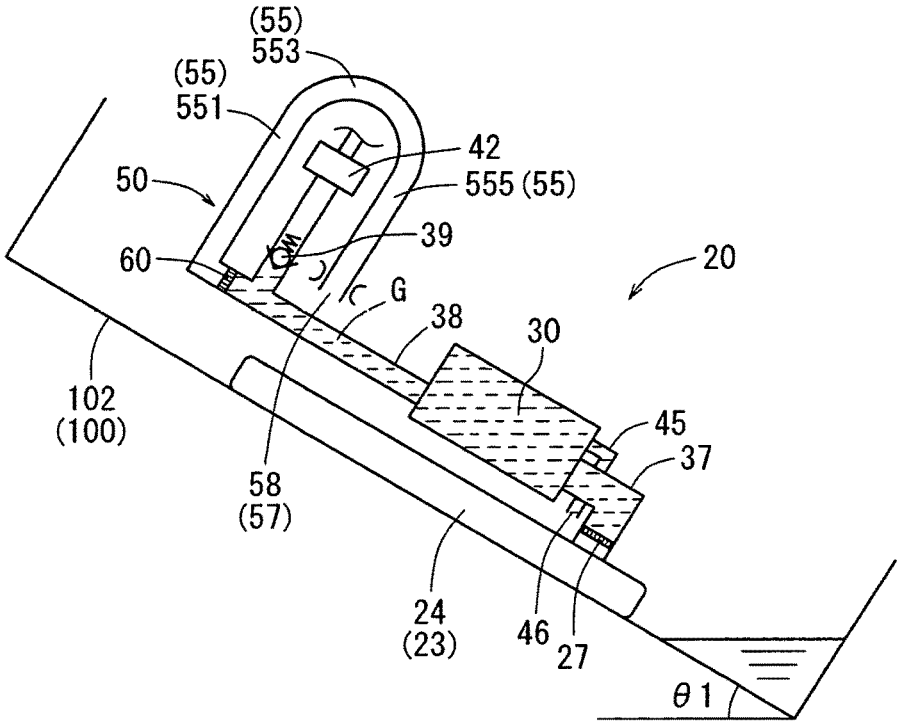
FIG. 6 is a schematic view showing the pump unit when a vehicle is tilted to the right side.
Figure 7:
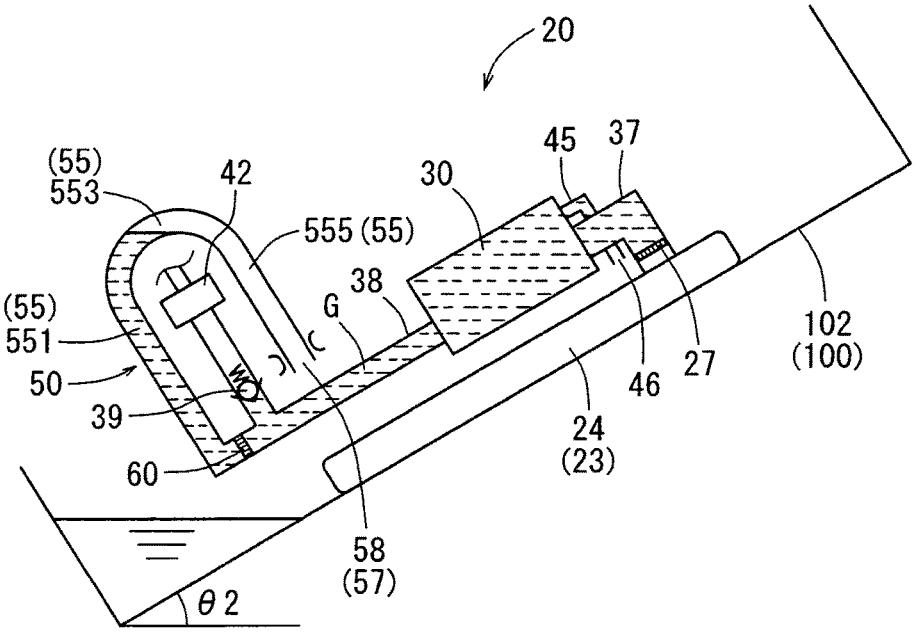
FIG. 7 is a schematic view showing the pump unit when the vehicle is tilted to the left side.

Hereinafter, the above-described action on preventing the "liquid drop" of the pump unit 20 will be described. The schematic view in FIG. 6 shows the pump unit 20 tilted to the right side when a vehicle is parked. The schematic view in FIG. 7 shows the pump unit 20 tilted to the left side when a vehicle is parked. FIGS. 6 and 7 are illustrated in the assumption that a vehicle is parked on a slope inclined in the lateral direction. The pump unit 20 is schematically shown in FIGS. 6 and 7 with the reference numerals that are the same as the above description.

When the vehicle is parked at a negative slope (upward to downward traversing in the left-to-right direction), the fuel tank 100 is tilted to the right side as shown in FIG. 6. Accordingly, the pump unit 20 which is placed on the bottom wall 102 within the fuel tank 100 is also tilted to the right side. More specifically, when the fuel tank 100 is tilted in this manner, the position of the mesh member 60 is relatively higher than the position of the vapor outlet 46 of the vapor outlet passage 45. Consequently, the gasoline G filled in the outlet pipe 38 and the fuel pump 30 attempts to flow out of the vapor outlet 46 under the action of gravity. The gasoline G will not flow out to the outside via the inlet pipe portion 37 since the inlet pipe portion 37 is closed by the valve 27. On the other hand, it is possible that the gasoline G may flow to the outside through the vapor outlet 46 since no flow-blocking component corresponding to the valve 27 is provided at the vapor outlet passage 45 having the vapor outlet 46. However, by preventing air from entering into the outlet pipe 38 due to the check valve 39 and the mesh member 60 provided on the discharge port side, the fuel tank 100 is configured so that the gasoline G will not flow out to the outside through the vapor outlet 46.

More particularly, since the check valve 39 is provided in the piping member 43 of the outlet pipe 38, air is restricted from entering into the outlet pipe 38 from the piping member 43. Since the mesh member 60 is provided in the leak passage 50, even when air enters from the outlet port 58 of the leak passage 50 into curved hose 55, the mesh member 60 establishes the interface between the air and gasoline G therein. In particular, since the mesh member 60 includes the fine pores, the mesh member 60 actively generates the interface between the air and gasoline G. Here, because of the small size of the fine pores, the interfacial tension of the interface generated in the mesh member 60 acts to prevent the entrance of air into the outlet pipe 38. Thus, the mesh member 60 may prevent air from entering into the outlet pipe 38 from the curved hose 55 of leak passage 50.

The interfacial tension generated in the mesh member 60 may be strong enough to bear the weight of gasoline G present between the mesh member 60 and the vapor outlet 46, in order to restrict the gasoline G from flowing out from the vapor outlet 46 when the fuel tank 100 is tilted (at the angle of θ1) as shown in FIG. 6. In this manner, the above-described fuel supply device 10 can ensure the "liquid drop" prevention functionality for preventing the "liquid drop" phenomenon that is caused when the pumping-up operation of the fuel pump 30 is stopped, while reducing the number of the components, as well as also ensuring the excellent restartability of an engine while configuring the fuel supply device 10 at a low cost.

When an automobile turns left, lateral acceleration is applied on the right side. This causes the pump unit 20 to be subjected to an action load similar to the load when the fuel tank 100 is tilted as shown in FIG. 6. More specifically, the lateral gravitational acceleration is applied to the pump unit 20 such that the pump unit 20 is in substantially a similar condition to a condition when it is tilted as shown in FIG. 6. In this case also, as with the last case, the interfacial tension generated in the mesh member 60 serves to bear the weight of the gasoline G present between the mesh member 60 and the vapor outlet 46 to prevent the gasoline G from flowing out of the vapor outlet 46. When the assumed maximum value of the lateral acceleration is applied in such case, it may cause the tilt angle (angle θ1) of the fuel tank 100 to be about 45 degrees in the configuration shown in FIG. 6. Therefore, it is desirable that the interfacial tension generated in the mesh member 60 be able to bear the weight of the gasoline G present between the mesh member 60 and the vapor outlet 46 to such an extent as to prevent the gasoline from flowing out even when the tilt angle (angle θ1) reaches 45 degrees.

As described, the interfacial tension generated in the mesh member 60 may be appropriately determined in order to bear the weight of the gasoline G present between the mesh member 60 and the vapor outlet 46 that may flow out of the vapor outlet 46 even when the fuel tank 100 is tilted (at an angle of θ1) as shown in FIG. 6. Further, the mesh member 60 may be appropriately designed so that the interfacial tension generated therein may bear the weight of the gasoline G present between the mesh member 60 and the vapor outlet 46 to prevent it from flowing out of the vapor outlet 46 even when the lateral acceleration is applied to the right side due to the left turning motion of an automobile, causing a tilt up to an angle of 45 degrees for θ1.

Conversely, the fuel tank 100 may also be tilted to the left side (at an angle of θ2) as shown in FIG. 7, when the vehicle is parked at a positive slope (downward to upward traversing in the left-to-right direction). Accordingly, due to the car being inclined at a positive slope, the pump unit 20 placed on the bottom wall 102 within the fuel tank 100 may also consequently be tilted to the left side, at a positive slope. More specifically, the fuel tank 100 may be tilted such that the position of the vapor outlet 46 of the vapor outlet passage 45 is relatively higher than the position of the mesh member 60. Consequently, the gasoline G filled within the outlet pipe 38 and the fuel pump 30 is subjected to flow governed by gravity. That is, the gasoline G in the outlet pipe 38 may attempt to flow out of the discharge port 58 of the fuel discharge port 57 such that air may attempt to enter inside of the outlet pipe 38 from the vapor outlet 46. However, because the suction pipe 37 is closed by the valve 27, the air cannot enter the inside the outlet pipe 38 from the vapor outlet 46.

According to the fuel supply device 10, since the leak passage 50 is provided with the first passage portion 551 extending downward to upward, approximately vertically as described above, the fuel within this first passage portion 551 is prevented from being discharged out of the discharge port 58 of the fuel discharge port 57, since the direction of gravity acting on said vertical portion makes the gasoline G flow downwards towards mesh member 60. In the bent configuration presented in FIG. 7, the vertical level of the bent passage portion 553 located at the upper end of this leak passage 50 is higher in the up-to-down direction than the level of the vapor outlet 46 of the pump unit 20 when it is tilted to the left side as shown in FIG. 7. Therefore, the gasoline G within the first passage portion 551 may be prevented from flowing out of the discharge port 58 of the fuel discharge port 57 when this pump unit 20 is tilted, and consequently, air cannot enter the inside from the vapor outlet 46. Consequently, even when the vehicle is parked on a slope, the inside of the outlet pipe 38 is maintained in a filled state with the fuel structurally arranged according to the bent passage 553 to gravitationally prevent the "liquid drop" while the fuel supply device 10 can be configured at a low cost while reducing the number of the components, and further while ensuring better restartability of an engine to which the fuel supply device may be connected.

Further, when lateral acceleration is applied to the left side due to the right turning motion of an automobile, the pump unit 20 is subjected to a similar action load as the load when the fuel tank 100 is tilted as shown in FIG. 7. More specifically, the lateral acceleration is applied such that the liquid level of the gasoline G is tilted with respect to the fuel tank 100 as shown in FIG. 7. In the height direction at the top of the liquid level of this gasoline G, the position of the bent passage portion 553 is relatively higher than the position of the vapor outlet 46. In this case, as described-above, because of gravity acting on the first passage portion 551 and bent passage portion 553 up to the extent of the level, pushing the fluid back towards the mesh member 60, the fuel within the first passage portion 551 is prevented from flowing out of the discharge port 58 of the fuel discharge port 57 so that the air cannot enter from the vapor outlet 46 in the inside. In this way, even when the lateral acceleration is applied to the fuel within the fuel tank 100 due to the right turning motion of a vehicle, the inside of the outlet pipe 38 may be kept being filled with the fuel to prevent the "liquid drop".

Incidentally, when the assumed maximum value of the lateral acceleration is applied, it may cause an analogous situation to the negative slope situation described above, wherein at a positive slope here, the tilt angle (angle θ2) of the fuel tank 100 would be approximately 45 degrees at maximum lateral acceleration (see FIG. 7). Therefore, the position of the level of the bent passage portion 553 is preferably configured to be relatively higher than the position of the level of the vapor outlet 46 even when the tilt angle θ of the fuel tank 100 reaches maximum 45 degrees.

Figure 8:
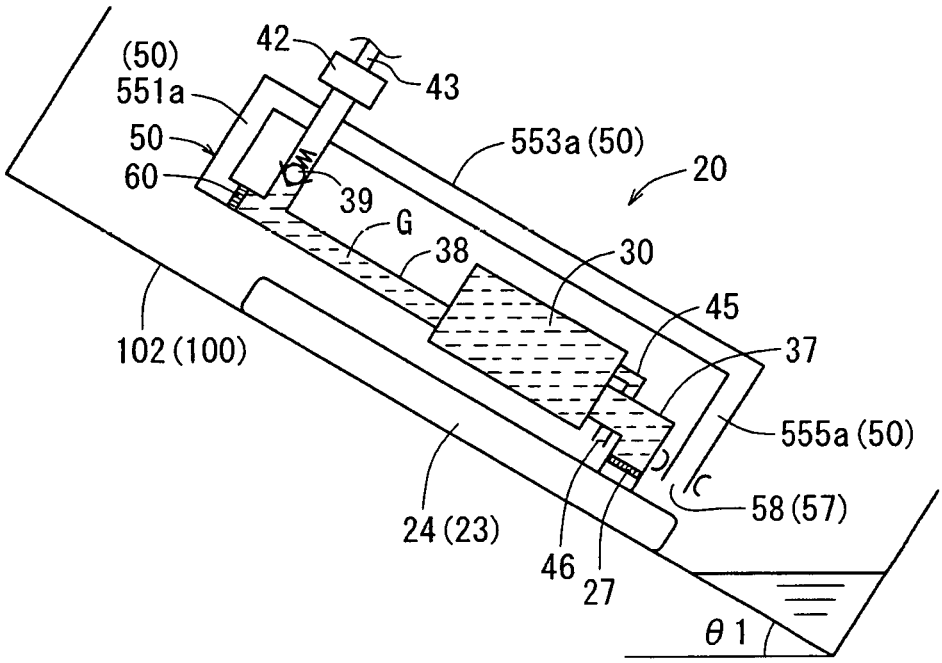
FIG. 8 is a schematic view showing an embodiment of a pump unit when the vehicle is tilted to the right side.
Figure 9:
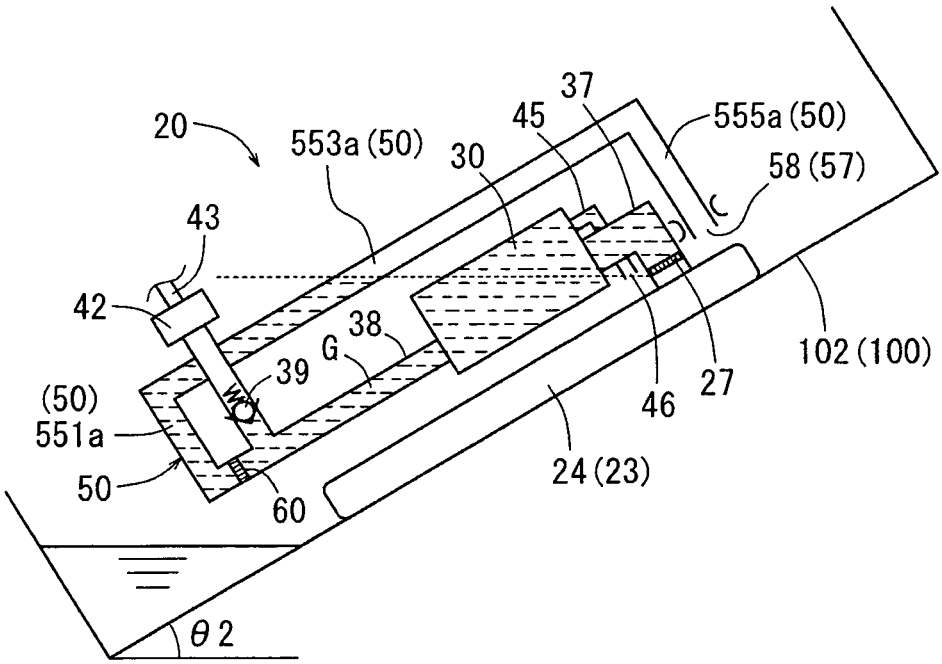
FIG. 9 is a schematic view showing the pump unit of FIG. 8 when the vehicle is tilted to the left side.

Hereinafter, FIGS. 8 and 9 illustrates schematic views of a modified embodiment of the fuel supply device 10. FIG. 8 is a view corresponding to FIG. 6 of the above-described embodiment showing the pump unit when the vehicle is inclined at a negative slope. FIG. 9 is a view corresponding to the above-described embodiment of FIG. 7 showing the pump unit when the vehicle is inclined at a positive slope. In the present modified embodiment, the components having the same configuration as the above-described embodiments are assigned with the same reference numerals and their description may be omitted.

In the modified embodiment shown in FIGS. 8 and 9, the position of the discharge port 58 of the fuel discharge port 57, that corresponds to 57 of the embodiment shown in FIGS. 6 and 7, is determined to be in the vicinity of the vapor outlet 46 of the vapor outlet passage 45. In detail, the arrangement of the first passage portion 551, the bent passage portion 553 and the second passage portion 555, which define the leak passage 50 according to the above-described embodiments (shown in FIGS. 6 and 7) is modified to the arrangement as shown in FIGS. 8 and 9. No modification has been made to the other construction. In other words, the arrangement of the inlet pipe portion 37 from the fuel filter 23 to the fuel pump 30 and the arrangement of valve 27 remains identical. Further, the piping structure from the fuel pump 30 via the outlet pipe 38, the check valve 39 to the pressure regulator 42 also remains identical. Further, the arrangement of the mesh member 60 is also identical.

The leak passage 50 according to the modified embodiment shown in FIGS. 8 and 9, comprises the first passage portion 551*a*, the bent passage portion 553*a* and the second passage portion 555*a*. This leak passage 50 is formed such that the first passage portion 551*a*, the bent passage portion 553*a* and the second passage portion 555*a* are continuous in this order from upstream to downstream of the fuel flow. The downstream end of the second passage portion 555*a* forms a discharge port 58 of the fuel discharge port 57.

As with the aforementioned embodiment of FIGS. 6 and 7, the first passage portion 551*a* shown in FIGS. 8 and 9 is determined as a passage extending from bottom to top from upstream to downstream, however, its length is shorter than the passage 551 of the above-described embodiment.

The bent-down portion 553*a* is defined as a passage between the first passage portion 551*a* and the second passage portion 555*a*, and is arranged above and substantially parallel to both the suction pipe 37 and discharge pipe 38 arranged downstream to the left of, and upstream to the right of, the fuel pump 30, respectively. The bent portion 553*a* is continuous from the upstream first passage portion 551*a* to the downstream second passage portion 555*a*. Therefore, the length of the bent passage portion 553*a* is formed to be longer than the bent portion 553 of the aforementioned embodiment shown in FIGS. 6 and 7. The arrangement height of the bent passage portion 553*a* is significantly lower than the height position of the bent passage portion 553 shown in FIGS. 6 and 7.

The second passage portion 555*a* shown in FIGS. 8 and 9 is formed as a passage extending upwards to downwards from its upstream end to its downstream end. Further, the upstream end of the second passage portion 555*a* is continuous with the downstream side of the bent passage portion 553*a* while the downstream end of the bent passage portion 553*a* is defined as the discharge port 58 of the fuel discharge port 57. The second passage portion 555*a* is arranged such that the position of the discharge port 58 of the fuel discharge port 57 is in the vicinity to the vapor outlet 46 of the vapor outlet passage 45. The fuel discharge port 57 is provided integrally with the sub-tank 21.

Hereinafter, the action on preventing the "liquid drop" of the pump unit 20 according to the above-described modified embodiment will be described. The action on preventing the "liquid drop" when the fuel tank is at a negative slope as shown in FIG. 8 also works as an action on preventing the "liquid drop" in the same manner as the embodiment shown in the above-described FIG. 6 even in the modified embodiment having the different arrangement of the leak passage 50.

Further, the action on preventing the "liquid drop" when the fuel tank is at a positive slope as shown in FIG. 9 also works as an action on preventing the "liquid drop" in the substantially same manner as the embodiment shown in the above-described FIG. 7. Specifically, in the modified embodiment shown in FIG. 9, even if the position of the bent passage portion 553*a* is determined to be lower than that of the embodiment shown in FIG. 7, the bent passage portion 553*a* is formed to be longer in the longitudinal direction of pump 30, to extend up to the fuel discharge port 57. Accordingly, when tilted to the left side at a positive slope as shown in FIG. 9, the longer longitudinal portion of the bent passage portion 553*a* acts on preventing the "liquid drop" in the same manner as the height of the first passage portion 551 of the embodiment shown in FIG. 7, by directing the fluid present at the level of the bent passage portion 553*a* downwards due to gravity toward the mesh member 60.

In the modified embodiments shown in the above-described FIGS. 8 and 9, the height of the first passage portion 551*a* and the bent passage portion 553*a* of the leak passage 50 are determined to be lower than that of the embodiment shown in FIGS. 6 and 7. Therefore, it is possible to mount the modified pump unit 20 to a fuel tank 100 having a smaller upwards-to-downwards height in the vertical direction.

The fuel supply device according to the present disclosure is not limited to have a structure as the fuel supply device 10 according to the above-described embodiment but may be configured by modifying, adding or cancelling the appropriate structures.

For example, a canister may be attached to the flange unit 11 or the structure of the coupling mechanism 88 may be appropriately changed.

The invention claimed is:

1. A fuel supply device for feeding fuel to an internal combustion engine, the fuel supply device comprising:

a pump configured to pump fuel from within a tank via a suction pipe;

a fuel supply passage configured to feed the fuel pumped by the pump to the internal combustion engine;

a leak passage coupled to the fuel supply passage, wherein the leak passage is configured to branch the fuel pumped up by the pump away from the fuel supply passage to the tank separately from the suction pipe; and a vapor outlet passage configured to discharge vapor from the pump;

wherein a mesh member is arranged within the leak passage, and wherein the mesh member is configured to generate an interfacial tension at an interface between fuel and air within the leak passage.

2. The fuel supply device of claim 1, wherein when the tank is tilted such that a position of the mesh member is relatively higher than a position of a vapor outlet of the vapor outlet passage, the interfacial tension generated by the mesh member is configured to bear a weight of fuel present between the mesh member and the vapor outlet to prevent the fuel from flowing out of the vapor outlet.

3. The fuel supply device of claim 1, wherein when lateral acceleration is applied to the tank in a direction from the mesh member to a vapor outlet of the vapor outlet passage, the interfacial tension generated by the mesh member is configured to bear a weight of fuel present between the mesh member and the vapor outlet to prevent from flowing out of the vapor outlet.

4. The fuel supply device of claim 1, wherein the leak passage includes:

a first passage portion extending downwards to upwards from an upstream end to a downstream end of the first passage portion, wherein the upstream end of the first passage portion is connected to a branched part from the fuel supply passage;

a bent passage having an upstream end continuous with the downstream end of the first passage portion and having a downstream end bent downward such that an extending direction from the first passage portion is bent downward; and a second passage portion extending upwards to downwards from an upstream end to a downstream end, wherein the upstream end of the second passage portion is continuous with the downstream end of the bent passage and wherein the downstream end of the second passage portion is connected to a fuel discharge port located below the leak passage.

5. The fuel supply device of claim 4, wherein the first passage portion of the leak passage is configured such that a position of the bent passage portion is relatively higher than a position of a vapor outlet of the vapor outlet passage when the tank is tilted such that the position of the vapor outlet is relatively higher than a position of the mesh member.

6. The fuel supply device of claim 4, wherein the first passage portion of the leak passage is configured such that a position of the bent passage portion is relatively higher than a position of a vapor outlet of the vapor outlet passage in a height direction intersecting a fuel liquid level, which is tilted due to a lateral acceleration, when the lateral acceleration is applied to the tank in a direction from the vapor outlet toward the mesh member.

7. The fuel supply device of claim 4, wherein an outlet of the second passage portion is disposed on a same longitudinal side of the pump as a vapor outlet of the vapor outlet passage.

8. The fuel supply device of claim 1, wherein the leak passage comprises a fuel discharge port that is configured to return the fuel into the fuel tank, wherein the fuel discharge port is oriented to dispense fuel towards a filter for fuel pumped up by the pump, wherein the suction pipe is coupled between the filter and the pump; and wherein the vapor outlet passage comprises a vapor outlet that is configured to return the vapor into the tank, wherein the vapor outlet passage is oriented toward the filter.

9. A fuel supply device for feeding fuel to an internal combustion engine, the fuel supply device comprising:

a pump formed as an elongated cylinder, wherein a longitudinal direction of the pump is disposed laterally, and wherein the pump is configured to pump fuel from within a tank;

a fuel supply passage that is downstream from an outlet of the pump, wherein the fuel supply passage comprises a check valve configured to allow fuel pumped up by the pump to flow toward the internal combustion engine;

a leak passage extending orthogonally, in a vertical direction, from the fuel supply passage, wherein the leak passage is configured to branch the fuel pumped up by the pump away from the fuel supply passage to the tank; and a vapor outlet passage extending from an upstream lateral end of the pump, wherein the vapor outlet passage comprises a vapor outlet and is configured to discharge vapor from the pump through the vapor outlet, wherein the vapor outlet extends downwards in the vertical direction, wherein a mesh member is arranged within the leak passage, downstream of the check valve, and wherein the mesh member is configured to generate interfacial tension at an interface between fuel and air in the mesh member.

10. The fuel supply device of claim 9, wherein the mesh member comprises pores that are configured to allow the fuel fed from the fuel pump to pass therethrough.

11. The fuel supply device of claim 9, wherein the leak passage is formed by a flexible hose which forms an upside-down U shape, wherein an upstream end of the leak passage is orthogonal to and extends from the fuel supply passage, and wherein a downstream end of the leak passage extends into a fuel discharge port located below the leak passage.

12. The fuel supply device of claim 10, wherein the leak passage includes:

a first passage portion extending downwards to upwards substantially vertically from an upstream end of the first passage portion to a downstream end of the first passage portion, wherein the upstream end of the first passage portion is connected to a branched part that extends orthogonally from the fuel supply passage;

a bent passage including an upstream end that is continuous with the downstream end of the first passage portion, wherein the bent passage is bent in an upside-down U shape without any purely vertical portion, such that the bent portion extends upward from the downstream end of the first passage portion at an incline, and returns downward to substantially the same vertical level as the downstream end of the first passage portion at a decline; and a second passage portion extending upwards to downwards substantially vertically from an upstream end of the second passage portion to a downstream end of the second passage portion, wherein the upstream end of the second passage portion is continuous with the downstream end of the bent passage and wherein the downstream end of the second passage portion is connected to a fuel discharge port located below the leak passage.

13. The fuel tank of claim 12, wherein when the tank is tilted at a negative slope, a position of the mesh member is relatively higher than a position of a vapor outlet of the vapor outlet passage and the interfacial tension generated by the mesh member is configured to bear a weight of fuel present between the mesh member and the vapor outlet to prevent the fuel from flowing out of the vapor outlet.

14. The fuel supply device of claim 12, wherein when lateral acceleration is applied to the tank in a longitudinal lateral direction of the tank, from the mesh member to a vapor outlet of the vapor outlet passage, the interfacial tension generated by the mesh member is configured to bear the weight of fuel present between the mesh member and the vapor outlet to prevent vapor from flowing out of the vapor outlet.

15. The fuel supply device of claim 12, wherein the bent passage portion of the leak passage is configured such that a vertical position of the bent passage portion is relatively higher than a vertical position of the vapor outlet of the vapor outlet passage even when the tank is tilted at a positive slope, and wherein when the tank is tilted at a positive slope, the position of the vapor outlet is relatively higher than a position of the mesh member.

16. The fuel supply device of claim 15, wherein when the tank is tilted at a positive slope, a liquid level of the bent passage portion of the leak passage is affected by vertically downward gravitational force acting to push any liquid present in the leak passage downwards and upstream toward the mesh member.

17. The fuel supply device of claim 12, wherein the leak passage is configured such that a vertical liquid level position within the bent passage portion is relatively higher than a position of a vapor outlet of the vapor outlet passage in the vertical height direction when the tank is tilted at 45 degrees with respect to a horizontal direction.

18. A fuel supply device for feeding fuel to an internal combustion engine, the fuel supply device comprising:

a pump formed as an elongated cylinder, wherein a longitudinal direction of the pump is disposed laterally, and wherein the pump is configured to pump fuel from within a tank;

a fuel supply passage that is downstream from an outlet of the pump, wherein the fuel supply passage comprises a check valve configured to allow fuel pumped by the pump to flow toward the internal combustion engine;

a leak passage extending orthogonally, in a vertical direction, from the fuel supply passage, wherein the leak passage is configured to branch the fuel pumped by the pump away from the fuel supply passage to the tank; and a vapor outlet passage extending from an upstream lateral end of the pump, wherein the vapor outlet passage comprises a vapor outlet and is configured to discharge vapor from the pump through the vapor outlet, wherein the vapor outlet extends downwards in the vertical direction, wherein a mesh member is arranged within the leak passage, downstream of the check valve, and wherein the mesh member is configured to generate interfacial tension at an interface between fuel and air in the mesh member, and wherein the leak passage includes:

a first passage portion extending downwards to upwards substantially vertically from an upstream end of the first passage portion to a downstream end of the first passage portion, wherein the upstream end of the first passage portion is connected to a branched part that extends orthogonally from the fuel supply passage;

an elongated passage including an upstream end that is orthogonal to the downstream end of the first passage portion, wherein the elongated passage extends parallel to a lateral longitudinal direction of the pump and traverses over a breadth of the pump to a downstream end of the elongated passage, and a second passage portion parallel to the first passage portion, extending upwards to downwards substantially vertically from an upstream end of the second passage portion to a downstream end of the second passage portion, with the upstream end of the second passage portion is orthogonal to the downstream end of the elongated passage and wherein the downstream end of the second passage portion is connected to a fuel discharge port located below the leak passage.

19. The fuel supply device of claim 18, wherein an outlet of the second passage portion is disposed on a same longitudinal side of the pump as a vapor outlet of the vapor outlet passage.

20. The fuel supply device of claim 1, comprising:

a check valve and a pressure regulator disposed along the fuel supply passage, wherein the pressure regulator is downstream of the check valve; and wherein the leak passage is coupled to the fuel supply passage at a point that is upstream of the check valve and the pressure regulator.

* * * * *